United States Patent [19]

Snyder

[11] 4,404,772

[45] Sep. 20, 1983

[54] CYLINDRICAL GRINDING MACHINE

[75] Inventor: Glenn M. Snyder, Waynesboro, Pa.

[73] Assignee: Litton Industrial Products, Inc., Waynesboro, Pa.

[21] Appl. No.: 301,725

[22] Filed: Sep. 14, 1981

[51] Int. Cl.[3] ..... B24B 5/04

[52] U.S. Cl. ..... 51/105 R; 51/165.74; 51/238 S

[58] Field of Search ..... 51/95 WH, 105 R, 105 SP, 51/165.74, 165.77, 238 R, 238 S, 238 GG, 239; 82/38 R

[56] References Cited

U.S. PATENT DOCUMENTS

| | | | |
|---|---|---|---|
| 1,543,795 | 6/1925 | Rockwell | 51/165.74 |
| 1,914,578 | 6/1933 | Norton | 51/238 S |
| 2,750,715 | 6/1956 | Farnam | 51/238 S |
| 3,503,159 | 3/1970 | Schaller | 51/238 R |
| 3,731,566 | 5/1973 | Kurimoto et al. | 51/238 S |
| 4,055,027 | 10/1977 | Freddi | 51/165.77 |
| 4,324,073 | 4/1982 | Belthle | 51/238 S |

*Primary Examiner*—Harold D. Whitehead
*Assistant Examiner*—K. Bradford Adolphson
*Attorney, Agent, or Firm*—Spencer T. Smith

[57] ABSTRACT

A cylindrical grinding machine comprising chucks for supporting and rotating a workpiece about a selected axis, a wheelhead assembly selectively displaceable transverse to the axis including a rotatable grinding wheel for effecting stock removal from the surface of the rotating workpiece, a workrest assembly including a jaw having a workpiece engaging shoe, and means for selectively displacing the jaw for opposing the deflective force exerted by the grinding wheel on the rotating workpiece as it is machined, and means for monitoring the wear of the jaw including an indicator gauge mounted on the workrest jaw including a visually observable needle, a control arm pivotally secured to the workrest jaw having a first workpiece engaging end and a second end operatively associated with the indicator gauge, the control arm having a first position whereat the control arm first end leads the workrest shoe and a second position whereat the control arm first end is flush with the workrest shoe, and a spring for biasing the control arm towards the first position for maintaining the control arm first end in constant tracking engagement with the surface of a rotating workpiece whereby jaw wear will be indicated by the oscillation of the gauge needle and the degree of wear will be indicated by the magnitude of such oscillation.

1 Claim, 2 Drawing Figures

CYLINDRICAL GRINDING MACHINE

BACKGROUND OF THE INVENTION

The present invention relates to cylindrical grinding machines.

In cylindrical grinding machines a workpiece to be ground is supported between a pair of rotating chucks or work centers. The axis of the workpiece is aligned with the machine axis defined by the chucks and a rotating grinding wheel is advanced toward the rotating workpiece to abrasively remove stock from its cylindrical surface. The force of the grinding wheel tends to bow the axis of the workpiece and a workrest is provided to minimize such bowing.

Conventionally, the workrest has at least one jaw having a workpiece engaging shoe which is operated via a fixed program to support the rotating workpiece during machining. When the workpiece engaging shoe becomes worn, an adjustment is needed to assure proper functioning of the workrest. Failure to maintain the workpiece aligned with the machine axis will result in the workpiece being ground out of round (slightly egg-shaped).

BRIEF SUMMARY OF THE INVENTION

It is an object of the present invention to provide a cylindrical grinding machine having a mechanism for monitoring the wear of the workrest jaws during grinding.

Other objects and advantages of the present invention will become apparent from the following portion of this specification and from the accompanying drawings which illustrate, in accordance with the mandate of the patent statutes, a presently preferred embodiment incorporating the principals of the invention.

BRIEF DESCRIPTION OF THE DRAWINGS

Referring to the drawings.

DETAILED DESCRIPTION

Figure 1:
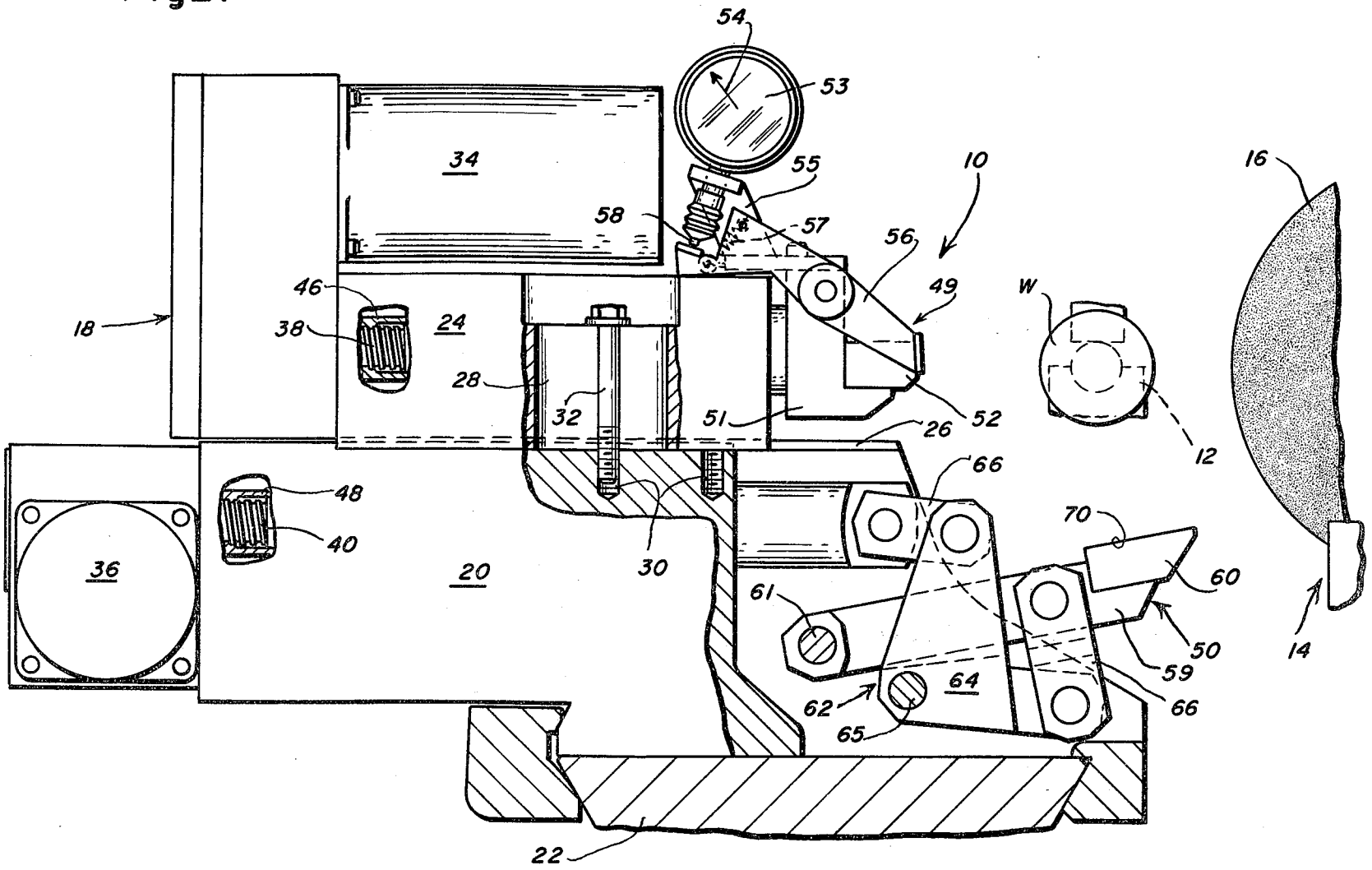
FIG. 1 is a side elevational view of a cylindrical grinding machine made in accordance with the teachings of the present invention.

The cylindrical grinding machine 10 generally includes a chuck assembly 12 at either end of the workpiece for rotatably driving a workpiece W about its axis, a wheelhead assembly 14 including at least one rotatable grinding wheel 16 advanceable to effect stock removal from the rotating workpiece, and a workrest assembly 18.

The workrest assembly includes a lower housing 20 rigidly attached to the grinding machine base 22 and an upper housing 24 which is slidably supported on lower housing ways 26. A pair of slots 28 (only one shown) are defined in the upper housing 24 and a plurality of threaded bores 30 are defined in the top surface of the lower housing 20. Accordingly, when the upper housing 24 is positioned at a selected location along the ways 26, a clamping bolt 32 may be fed through each slot 28 and threaded into the appropriate lower housing bore 30 to secure the upper housing 24 to the lower housing.

Upper and lower stepper motors 34, 36 secured to the respective workrest housing portions 24, 20, drive upper and lower feed screws 38, 40 through associated drive shafts 46, 48 to advance or retract upper 49 and lower 50 workrest jaw assemblies.

The upper workrest jaw assembly includes a jaw 51 having a workpiece engaging shoe 52 secured thereto. An indicator gauge 53, having a visual readout in the form of a pivotally mounted needle 54, is secured to the jaw 51 via a bracket 55, and a control arm 56 operatively associated with the gauge needle 54 is pivotally mounted on the upper jaw 51. A spring 57 extending from the bottom of the bracket 55 biases the control arm 56 to a first position in front of or leading the upper shoe 52. A spring biased follower 58 of the gauge 53 maintains constant engagement with the end of the remote pivotally mounted control arm 54.

The lower workrest assembly 50 includes a jaw 59 having a shoe 60 secured to the end thereof. This jaw 59 is pivotally mounted on the lower housing via a shaft 61 and is operatively controlled by the lower drive shaft 48 via a jack linkage 62 which includes a pivot block 64 (also pivotally mounted on the lower housing via a shaft 65) and two connecting pivot links 66 which pivotally connect one end thereof to the drive shaft and the other end to the lower jaw so that the shaft 48 may displace the lower jaw 58 to support a workpiece having a diameter which may vary over a relatively large range.

To set up the grinding machine for machining workpieces of a selected diameter, a workpiece W is positioned in the chucks 12 and the upper workrest housing 24 is horizontally advanced until upper shoe 52 engages the workpiece. Once positioned, the upper housing 24 is secured to the lower housing 20 with the clamping bolts 32. To complete set up, the lower stepper motor 36 is operated to raise the lower jaw 59 until the lower shoe 60 engages the workpiece. Thereafter, the upper and lower motors 34, 36 are operated during the grinding cycle according to fixed programs to feed and retract the workrest jaws 50, 59 in a conventional manner to follow the decreasing diameter of the workpiece.

Figure 2:
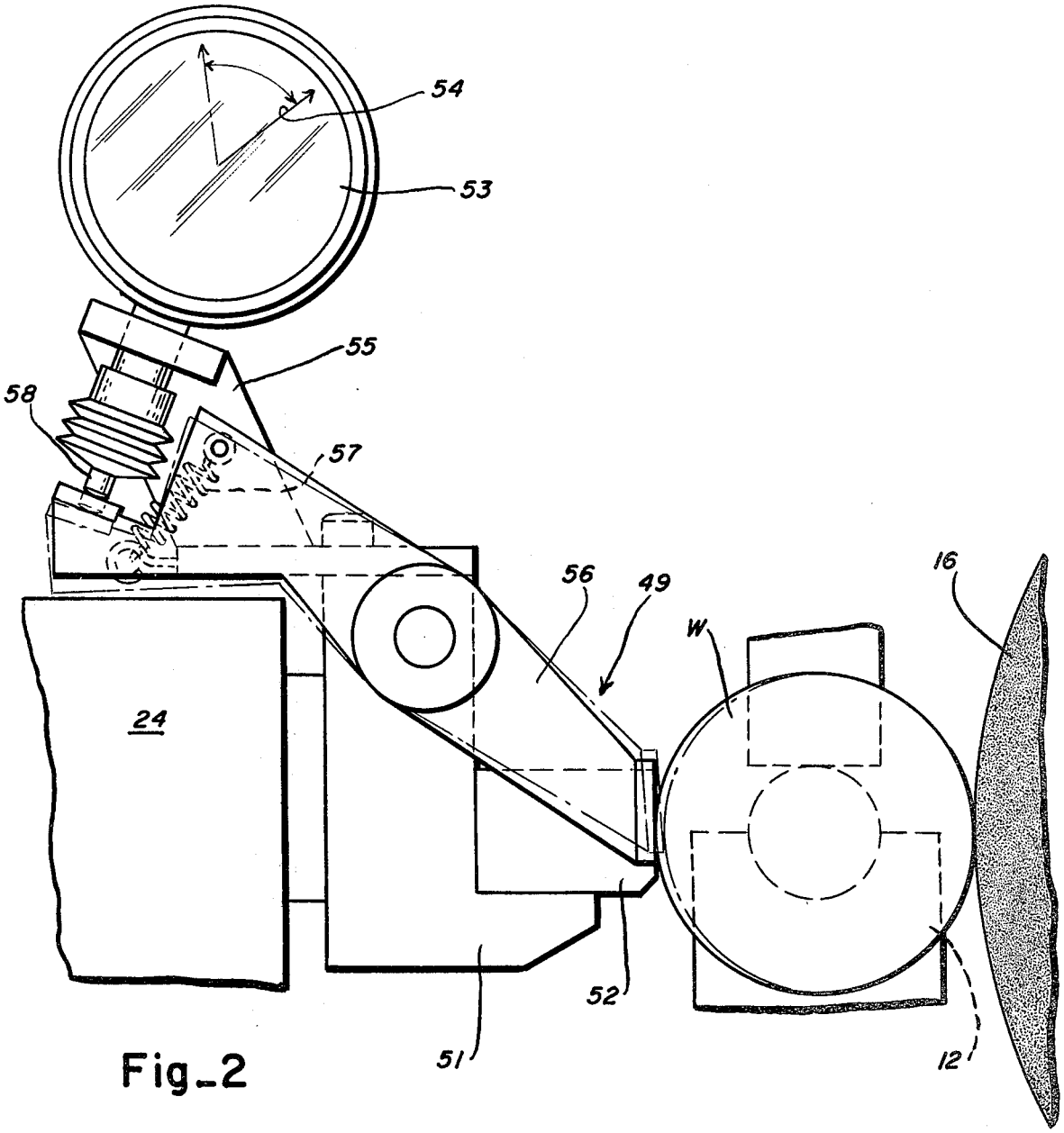
FIG. 2 is a partial side view of the workrest assembly illustrated in FIG. 1 supporting a workpiece during machining.

During the machining operation, the spring 57 biases the control arm 56 so that it will remain in constant engagement with the surface of the rotating workpiece. The fixed program for advancing the upper workrest will maintain the upper workrest jaw in constant engagement with this surface until jaw wear occurs. As the jaw wears down, the workrest will no longer constantly maintain engagement with the workpiece which will grind slightly out of round. The needle 54 which always tracks the workpiece surface will begin to oscillate (FIG. 2) indicating workrest jaw wear and the magnitude of this oscillation is indicative of the degree of wear. When the degree of out-of-roundness reaches an unallowable extent, compensation for workrest jaw wear can be affected. The indicator gauge 53, accordingly, produces a visual readout indicative of the roundness of the workpiece as it rotates. A constant reading indicates perfect roundness.

What is claimed is:

1. A cylindrical grinding machine comprising means for supporting and rotating a workpiece about a selected axis, wheelhead assembly means selectively displaceable transverse to said axis including a rotatable grinding wheel for effecting stock removal from the surface of the rotating workpiece, workrest assembly means including jaw means having a workpiece engaging shoe, and means for selectively displacing said jaw means for opposing the deflective force exerted by said grinding wheel on the rotating workpiece as it is machined, and means for monitoring the wear of said jaw means including indicator means mounted on said workrest jaw including a visually observable needle, control arm means pivotally secured to said workrest jaw means having a first workpiece engaging end and a second end operatively associated with said indicator means, said control arm means having a first position whereat said control arm first end leads said workrest shoe and a second position whereat said control arm first end is flush with said workrest shoe, and means for biasing said control arm means towards said first position for maintaining said control arm first end in constant tracking engagement with the surface of a rotating workpiece whereby jaw means wear will be indicated by the oscillation of said needle and the degree of wear will be indicated by the magnitude of such oscillation.

* * * * *